US007250714B2

(12) United States Patent
Pyun et al.

(10) Patent No.: US 7,250,714 B2
(45) Date of Patent: Jul. 31, 2007

(54) CATHODE RAY TUBE

(75) Inventors: Do-Hun Pyun, Suwon-si (KR); Sung-Hun Ji, Suwon-si (KR); Yeun-Gil Choi, Suwon-si (KR); Soon-Dong Jeong, Suwon-si (KR); Joon-Soo Bae, Suwon-si (KR)

(73) Assignee: Samsung SDI Co., Ltd., Sunwoan-si (KR)

( * ) Notice: Subject to any disclaimer, the term of this patent is extended or adjusted under 35 U.S.C. 154(b) by 80 days.

(21) Appl. No.: 11/159,438

(22) Filed: Jun. 21, 2005

(65) Prior Publication Data

US 2005/0285499 A1 Dec. 29, 2005

(30) Foreign Application Priority Data

Jun. 29, 2004 (KR) ..... 10-2004-0049411

(51) Int. Cl.
*H01J 29/86* (2006.01)
*H01J 29/80* (2006.01)

(52) U.S. Cl. ..... 313/477 R; 220/2.1 A

(58) Field of Classification Search ..... 313/477 R; 220/2.1 A, 2.3 A

See application file for complete search history.

(56) References Cited

U.S. PATENT DOCUMENTS 6,774,553 B2 * 8/2004 Pyun et al. ..... 313/477 R
7,005,792 B2 * 2/2006 Baek et al. ..... 313/477 R
7,084,561 B2 * 8/2006 Lee et al. ..... 313/477 R

* cited by examiner

*Primary Examiner*—Ashok Patel
(74) *Attorney, Agent, or Firm*—Christie, Parker & Hale, LLP

(57) ABSTRACT

A cathode ray tube includes a panel with inner and outer surfaces, a funnel connected to the panel, a neck connected to the rear of the funnel, and a shadow mask mounted within the panel. The inner surface of the panel satisfies the following condition:

$$0.2 \leqq Px \leqq 0.4,\ 0.3 \leqq Py \leqq 0.6$$

where when the inner surface of the panel is expressed by the following biquadratic:

$$z(x, y) = \sum_{i,j=0,2,4} A_{i,j} x^i y^j,$$

based on the central point of the inner surface of the panel with the three-dimensional orthogonal coordinates system defined by the x, y and z axes, Px and Py are defined by the following formula:

$$Px = \frac{A_{20}}{A_{20} + A_{40}},\quad Py = \frac{A_{02}}{A_{02} + A_{04}}$$

11 Claims, 4 Drawing Sheets

CATHODE RAY TUBE

CROSS REFERENCE TO RELATED APPLICATION

This application claims priority to and the benefit of Korean Patent Application No. 10-2004-0049411 filed on Jun. 29, 2004 in the Korean Intellectual Property Office, the entire content of which is incorporated herein by reference.

FIELD OF THE INVENTION

The present invention relates to a cathode ray tube, and in particular, to a cathode ray tube which has a panel with an improved inner surface and a shadow mask.

BACKGROUND OF THE INVENTION

Generally, a cathode ray tube (CRT) includes a panel with an inner phosphor screen, a funnel connected to the rear of the panel with a deflection yoke mounted around the outer circumference thereof, and a neck connected to the rear of the funnel with an electron gun mounted therein.

The phosphor screen has red, green and blue phosphor layers, and the electron gun emits three rays of electron beams toward the phosphor screen corresponding to respective three colors, red, green, and blue. The deflection yoke deflects the electron beams progressing in the funnel such that they scan the phosphor screen.

A shadow mask is fitted within the panel as a color selection electrode while being spaced apart from the phosphor screen. The shadow mask has a plurality of electron beam passage holes, and selects the three rays of electron beams emitted from the electron gun such that they land on the appropriate phosphor layer.

With the above-structured cathode ray tube, the panel may have a flat outer surface and a curved inner surface with a predetermined curvature. It has been proposed that the central thickness of the panel should be reduced to enhance the screen brightness and reduce the weight. However, in this case, X rays harmful to human body are emitted from the cathode ray tube due to the reduced central thickness. Therefore, a limit is imposed on reducing the thickness of the panel.

Furthermore, when the inner surface of the panel is varied in shape, the curvature characteristic of the shadow mask should be varied accordingly. However, the curvature characteristic of the shadow mask is related to the impact resistance characteristic thereof with respect to the external impact, such as accidental dropping of the panel. Consequently, when the inner surface of the panel and the curvature characteristic of the shadow mask are determined without considering the impact resistance characteristic of the shadow mask, the impact resistance characteristic is deteriorated, and thus decreasing the reliability of the device.

SUMMARY OF THE INVENTION

In one exemplary embodiment of the present invention, there is provided a cathode ray tube including a panel which improves the shape of the inner surface of the panel to reduce the weight of the panel while maintaining the X ray interception function thereof and enhancing the impact resistance characteristic of the shadow mask.

In an exemplary embodiment of the present invention, the cathode ray tube includes a panel with inner and outer surfaces, a funnel connected to the panel, a neck connected to the rear of the funnel, and a shadow mask mounted within the panel. The inner surface of the panel satisfies the following condition:

$$0.2 \leqq Px \leqq 0.4,\ 0.3 \leqq Py \leqq 0.6$$

where when the inner surface of the panel is expressed by the following biquadratic:

$$z(x, y) = \sum_{i,j=0,2,4} A_{i,j} x^i y^j,$$

based on the inner central point of the panel with the three-dimensional orthogonal coordinates system defined by the x, y and z axes, Px and Py are defined by the following formula:

$$Px = \frac{A_{20}}{A_{20} + A_{40}},\quad Py = \frac{A_{02}}{A_{02} + A_{04}}$$

In one embodiment, the outer surface of the panel is substantially flat, and the panel has an effective portion with a diagonal length of 580 mm or more.

In one embodiment, the panel has a center with a thickness of 12 mm or more.

In one embodiment, the shadow mask has an effective portion with electron beam passage holes, and when the horizontal pitch of the electron beam passage holes at the center of the effective portion is indicated by $Ph_1$ and the horizontal pitch of the electron beam passage holes at the ends of the effective portion by $Ph_2$, the ratio of $Ph_2/Ph_1$ is established to exceed 1.4.

In one embodiment, the panel satisfies the following condition:

$$0.25 \leqq Px \leqq 0.35,\ 0.35 \leqq Py \leqq 0.45.$$

BRIEF DESCRIPTION OF THE DRAWINGS

The above and other advantages of the present invention will become more apparent by describing embodiments thereof in detail with reference to the accompanying drawings in which.

DETAILED DESCRIPTION

Figure 1:
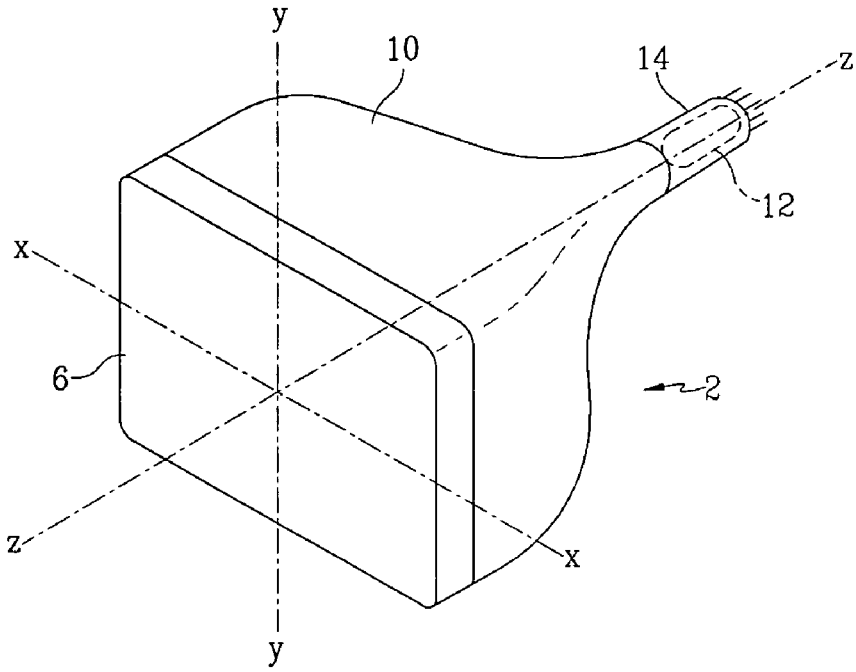
FIG. 1 is a perspective view of a cathode ray tube according to an embodiment of the present invention.
Figure 3:
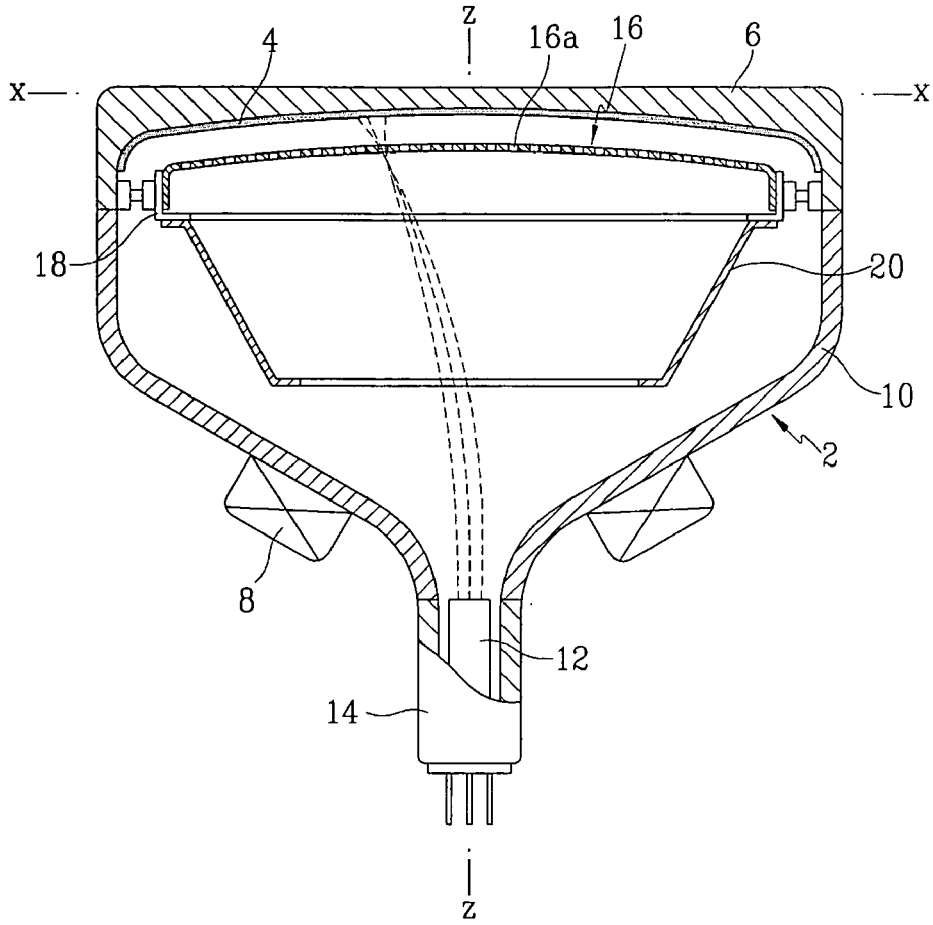
FIG. 3 is a partial sectional view of the cathode ray tube shown in FIG. 1.

FIG. 1 is a perspective view of a cathode ray tube according to an embodiment of the present invention. In FIGS. 1 and 3, for explanatory convenience, the horizontal axis of the screen is indicated by x, the vertical axis by y, and the tube axis proceeding parallel to the direction of migration of the electron beams by z.

As shown in the FIGS. 1 and 3, the cathode ray tube 2 includes a panel 6 with an inner phosphor screen 4, a funnel 10 connected to the rear of the panel 6, a deflection yoke 8 mounted at the outer circumference of the funnel 10, a neck 14 connected to the rear of the funnel 10, and an electron gun 12 mounted within the neck 14.

Figure 6:
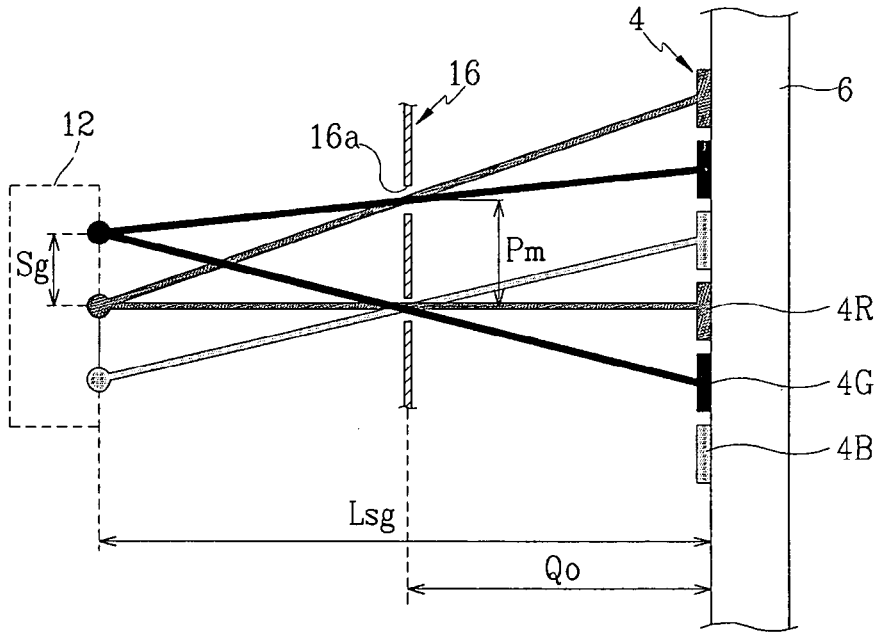
FIG. 6 schematically illustrates the inter-relation among the electron beams, the shadow mask and the phosphor screen.

As shown in FIG. 6, the phosphor screen 4 has red, green and blue phosphor layers, 4R, 4G and 4B. The electron gun 12 emits three rays of electron beams toward the phosphor screen 4 corresponding to the three-colored phosphor layers, respectively. The electron beams are varied in the current intensity in accordance with the screen signals, thereby exciting the relevant phosphor layers to the desired brightness. The deflection yoke 8 generates electric fields around the route of electron beams, and deflects the electron beams such that they scan the phosphor screen 4, according to the desired image.

A shadow mask 16 is fitted within the panel 6 while being spaced apart from the phosphor screen 4 with a predetermined distance $Q_0$. The shadow mask 16 has a plurality of electron beam passage holes 16*a*. The three rays of electron beams emitted from the electron gun 12 are converged at the electron beam passage holes 16*a* of the shadow mask 16 while passing through them, and land on the relevant phosphor layers. Thus, the electron beam passage holes 16*a* function as color selection electrodes.

Referring back to FIG. 3, the shadow mask 16 is supported by a mask frame 18, and fitted within the panel 6. An inner shield 20 is installed at the rear of the mask frame 18 and to reduce the landing variation of the electron beams due to the earth magnetic field.

The outer surface of the panel 6 is substantially flat, and the inner surface is curved with a predetermined curvature. The panel 6 has an improved shape (described below) to reduce its weight while maintaining the interception of the X rays harmful to the human body.

Figure 4:
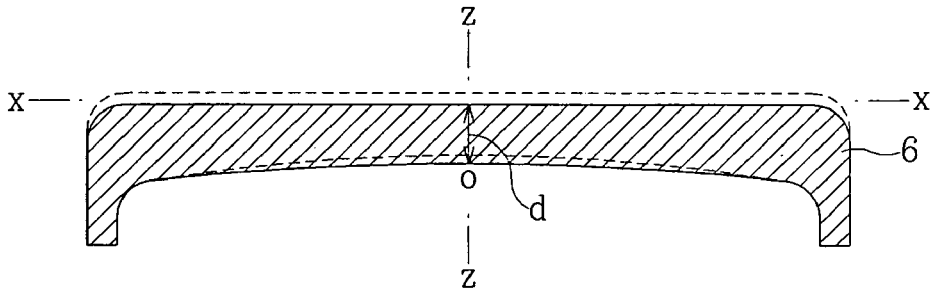
FIG. 4 is an amplified view of the panel shown in FIG. 3.

FIG. 4 includes an amplified view of the panel shown in FIG. 3 where the panel according to the present embodiment is indicated by a solid line, and a panel according to a prior art is indicated by a dotted line.

As shown in FIGS. 3 and 4, the panel 6 has a center with a minimal thickness d where inner curvature of the panel at that center is reduced. That is, the inner center point O of the panel 6 is shifted toward the shadow mask 16 (compared to prior art) while making the inner center portion flat and reducing the distance from the inner center to the shadow mask 16. In addition, the entire thickness of the panel 6 according to the present embodiment is reduced at the outer surface.

Such a shape variation reduces the thickness of the panel 6 at the outer surface without largely reducing the minimal thickness of the panel 6, thereby decreasing the volume of the panel 6 in an effective manner. As a result, the weight of the panel 6 is reduced while preventing the X rays harmful to the human body from being emitted to the outside of the cathode ray tube.

Figure 2:
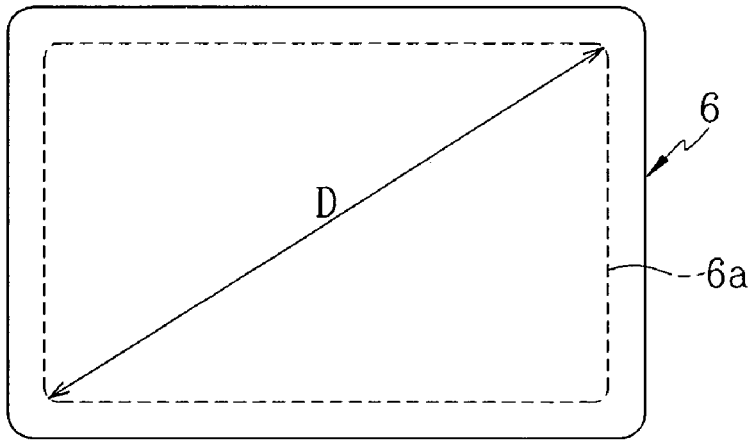
FIG. 2 is a front view of the panel shown in FIG. 1.

The diagonal size D (shown in FIG. 2) of the effective portion 6*a* of the panel 6 where the light is substantially emitted at is at least 580 mm. Also, the thickness d (shown in FIG. 4) of the panel 6 measured at the center is preferably 12 mm or more, considering its function of intercepting the X rays.

Furthermore, the curvature of the shadow mask 16 is determined depending upon the shape of the inner surface of the panel 6, which in turn, is determined depending upon the impact resistance of the shadow mask 16. The shape of the inner surface of the panel 6 is expressed by the biquadratic equation 1, based on the inner central point O of the panel 6 by way of the three-dimensional orthogonal coordinates system defined by the x, y and z axes.

$$z(x, y) = \sum_{i,j=0,2,4} A_{i,j} x^i y^j. \tag{1}$$

Where, (x, y) represent coordinates of a predetermined position, z is the displacement measured from the inner central point O at the predetermined (x, y) position, and $A_{i,j}$ are constants for determining the displacement and inner curvature of the panel.

Based on the equation 1, the factors Px and Py influencing the inner curvature of the panel 6 can be defined by the following formula:

$$Px = \frac{A_{20}}{A_{20} + A_{40}}, \quad Py = \frac{A_{02}}{A_{02} + A_{04}}. \tag{2}$$

Figure 5:
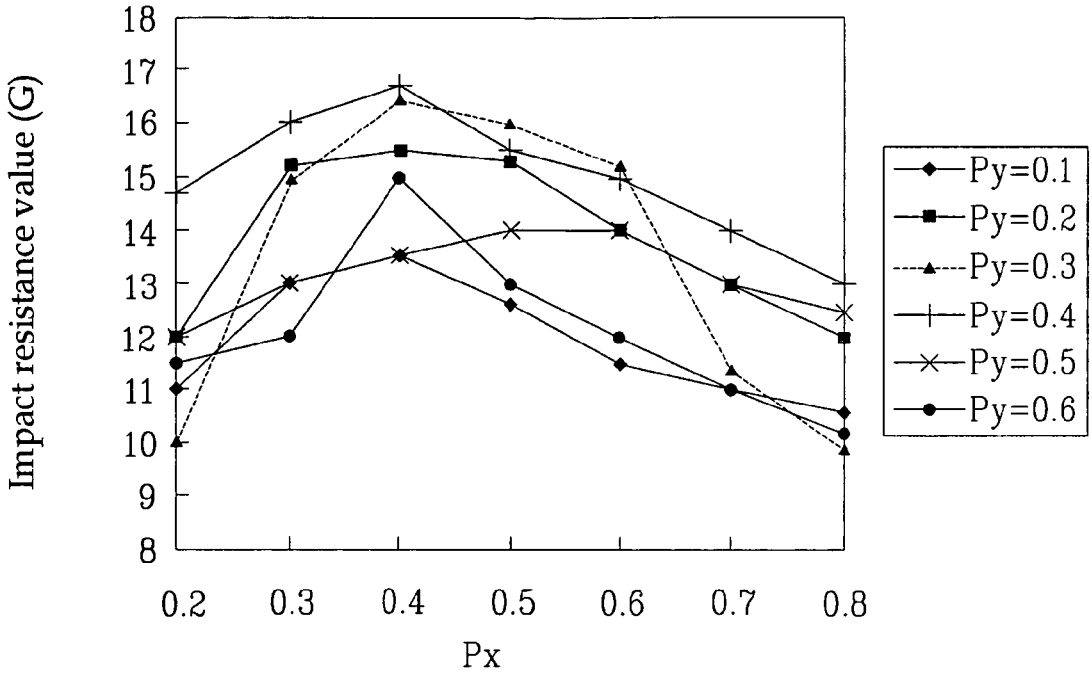
FIG. 5 is a graph illustrating the impact resistance values of the shadow mask designed in accordance with the shape of the inner surface of the panel.

The impact resistance values of the shadow mask 16 designed in accordance with the shape of the inner surface of the panel 6 as a function of the values of Px and Py are illustrated in FIG. 5 and Table 1. The impact applied to the cathode ray tube during its manufacturing process is expressed by the half-sine wave. This impact is regarded as safe, when the impact resistance of the shadow mask 16 is 15 G or more. The unit G of impact resistance is the unit of gravitational acceleration where, 1 G amounts to 9.8 m/s$^2$.

TABLE 1

| | | Px | | | | | |
|---|---|---|---|---|---|---|---|
| | | 0.1 | 0.2 | 0.3 | 0.4 | 0.5 | 0.6 |
| Py | 0.2 | 11 | 12 | 10 | 14.7 | 12 | 11.5 |
| | 0.3 | 13 | 15.2 | 15 | 16 | 13 | 12 |
| | 0.4 | 13.5 | 15.5 | 16.5 | 16.7 | 13.5 | 15 |
| | 0.5 | 12.6 | 15.3 | 16 | 15.5 | 14 | 13 |
| | 0.6 | 11.5 | 14 | 15.2 | 15 | 13.9 | 12 |
| | 0.7 | 11 | 13 | 11.4 | 14 | 13 | 11 |
| | 0.8 | 10.6 | 12 | 10 | 13 | 12.5 | 10.2 |

As listed in Table 1, when Px is in the range of 0.2-0.4 and Py in the range of 0.3-0.6, the impact resistance of the shadow mask 16 is in the range of 14-16.7 G. Particularly, when Px is in the range of 0.25-0.35 and Py in the range of 0.35-0.45, it turns out that the impact resistance of the shadow mask 16 exceeds 15 G, and involves excellent characteristic.

The optimal value of Px derived from FIG. 5 and Table 1 is in the range of 0.2-0.4, more preferably 0.25-0.35. Similarly, the optimal value of Py is in the range of 0.3-0.6, more preferably 0.35-0.45. When the panel 6 is structured to satisfy these conditions, the weight of the panel 6 can be reduced while maintaining the X ray interception function thereof and making the impact resistance characteristic of the shadow mask 16 excellent.

Meanwhile, when the panel 6 is structured to satisfy the above conditions, the typical electron beam landing characteristic can be maintained to be as usual by varying the horizontal pitch of the electron beam passage holes 16*a* formed at the shadow mask 16 without varying the curvature of the shadow mask 16.

As shown in the FIG. 6, the three rays of electron beams emitted from the electron gun 12 converge at any one of the electron beam passage holes 16*a* of the shadow mask 16 while passing through them, and diverge toward the relevant-colored phosphor layers 4R, 4G and 4B, thereby emitting light from them.

In FIG. 6, Sg indicates the distance between the two neighboring electron beams when three rays of electron beams are emitted from the electron gun 12 while being spaced apart from each other with a predetermined distance, and Pm indicates the horizontal pitch of the electron beam passage holes 16*a* measured at the center of the shadow mask 16. Lsg indicates the distance between the electron gun 12 and the phosphor screen 4, and Qo indicates the distance between the shadow mask 16 and the inner surface of the panel 6 at the center of the screen (the so-called Q value). Based on FIG. 6, the Q value Qo at the center of the screen can be expressed by the following formula:

$$Qo = \frac{Lsg \times Pm}{3Sg}. \quad (3)$$

In equation 3, because Lsg and Sg are constants with a predetermined value during the manufacturing of the cathode ray tube, it can be seen that Qo and Pm are proportional to each other. Accordingly, when the horizontal pitch Pm of the electron beam passage holes 16*a* at the center of the screen is reduced by the same amount that the Q value at the center of the screen is reduced due to the variation in the inner surface shape of the panel 6, the usual electron beam landing characteristic is maintained, without varying the curvature characteristic of the shadow mask 16.

Figure 7:
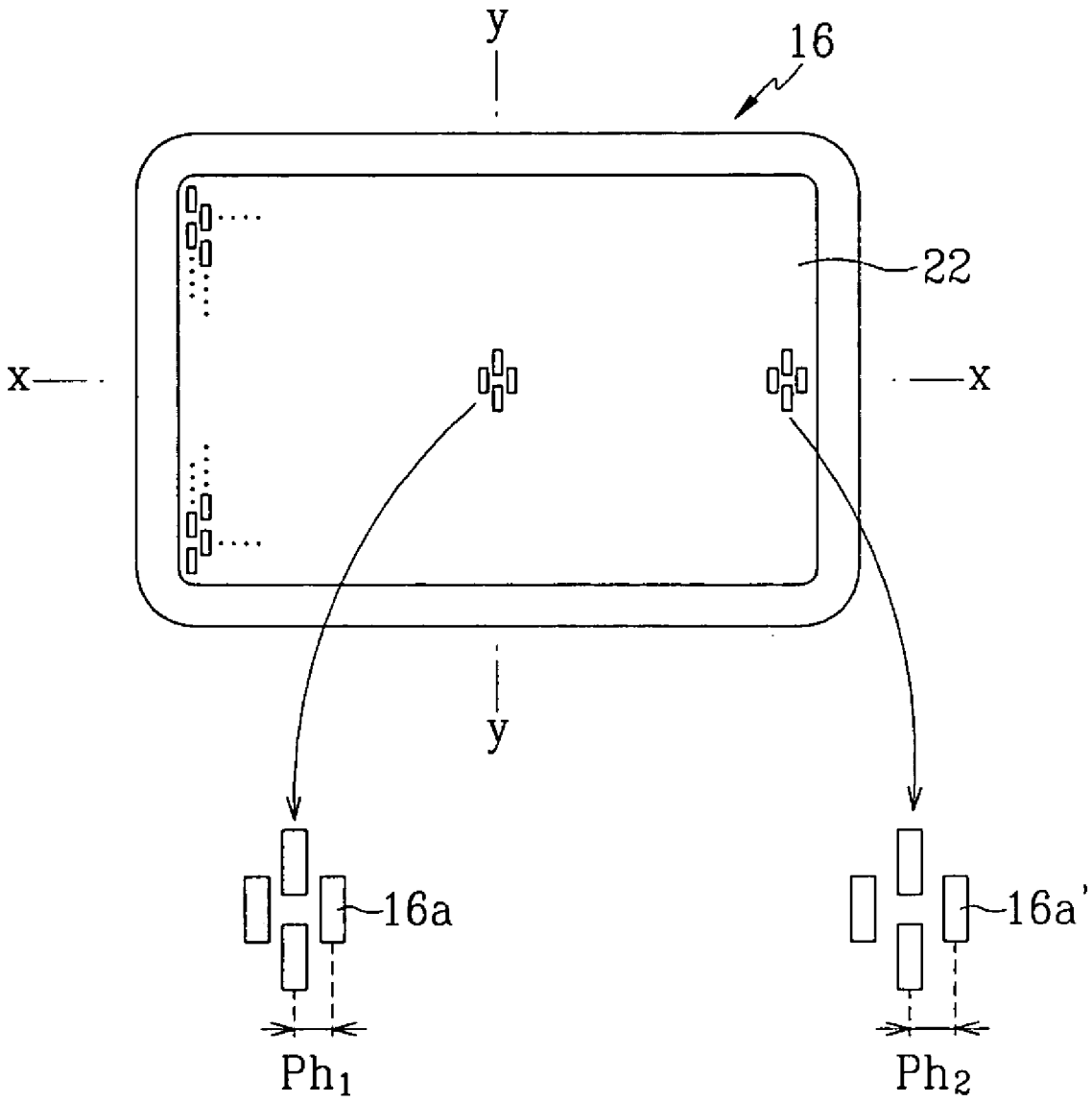
FIG. 7 is a front view of the shadow mask of the cathode ray tube, according to an embodiment of the present invention.

FIG. 7 is a front view of the shadow mask 16, which has an effective portion 22 with electron beam passage holes 16*a*. The horizontal pitch of the electron beam passage holes 16*a* placed at the center of the screen is indicated by $Ph_1$, and the horizontal pitch of the electron beam passage holes 16*a*' placed at the horizontal ends of the screen based on the central point is indicated by $Ph_2$. In this configuration, the ratio of $Ph_2$ to $Ph_1$ is established to exceed 1.4. When such a condition is satisfied, compared to the shadow mask of the conventional cathode ray tube, the horizontal pitch of the electron beam passage holes placed at the center of the screen can be lowered by about 10%, and hence, can cope with the reduced Q value.

The values of Px and Py of a panel according to a prior art (Comparative Example), and a panel according to the present embodiment (Example), the ratio of $Ph_2$ to $Ph_1$ of the shadow mask, and the weight of the panel are compared, and illustrated in Table 2.

TABLE 2

| | Px | Py | $Ph_1$ (μm) | $Ph_2/Ph_1$ | Panel weight (kg) |
|---|---|---|---|---|---|
| Comparative Example | 0.87 | 0.8 | 0.72 | 1.31 | 13.7 |
| Example | 0.39 | 0.3 | 0.65 | 1.42 | 12.7 |

As listed in Table 2, it can be seen that the weight of the panel in the cathode ray tube according to the Example is reduced by 1 kg, compared to that in the cathode ray tube according to the Comparative Example.

With the inventive cathode ray tube, the shape of the inner surface of the panel is improved to reduce the volume of the panel while maintaining its function of intercepting the X rays harmful to the human body, considering the impact resistance characteristic of the shadow mask. Consequently, the inventive cathode ray tube is advantageous in reducing the production cost due to the reduced weight of the panel, and the impact resistance characteristic thereof is enhanced while ensuring the easy handling thereof.

Although some embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A cathode ray tube comprising:

a panel including an inner surface and an outer surface;

a funnel having a rear and a front and connected to the panel at the front;

a neck connected to the rear of the funnel; and a shadow mask mounted within the panel;

wherein the inner surface of the panel satisfies the following condition:

$$0.2 \leqq Px \leqq 0.4,\ 0.3 \leqq Py \leqq 0.6$$

where when the inner surface of the panel is expressed by the following biquadratic $$z(x, y) = \sum_{i,j=0,2,4} A_{i,j} x^i y^j$$

where $A_{i,j}$ are constants, based on the inner central point of the panel with the three-dimensional orthogonal coordinates system defined by the x, y and z axes, Px and Py are defined by the following formula:

$$Px = \frac{A_{20}}{A_{20} + A_{40}},\quad Py = \frac{A_{02}}{A_{02} + A_{04}}.$$

2. The cathode ray tube of claim 1 wherein the outer surface of the panel is substantially flat.

3. The cathode ray tube of claim 1 wherein the panel has an effective portion with a diagonal length of at least 580 mm.

4. The cathode ray tube of claim 1 wherein the panel has a center with a thickness of at least 12 mm.

5. The cathode ray tube of claim 1 wherein the shadow mask has an effective portion with electron beam passage holes, and when the horizontal pitch of the electron beam passage holes at the center of the effective portion is indicated by $Ph_1$ and the horizontal pitch of the electron beam passage holes at the ends of the effective portion by $Ph_2$, the ratio of $Ph_2/Ph_1$ is established to exceed 1.4.

6. The cathode ray tube of claim 1 wherein the panel satisfies the following condition:

$$0.25 \leqq Px \leqq 0.35,\ 0.35 \leqq Py \leqq 0.45.$$

7. A panel for a cathode ray tube comprising:

an outer surface; and an inner surface, wherein the inner surface satisfies the following condition:

$$0.2 \leqq Px \leqq 0.4,\ 0.3 \leqq Py \leqq 0.6$$

where when the inner surface of the panel is expressed as $$z(x, y) = \sum_{i,j=0,2,4} A_{i,j} x^i y^j$$

where $A_{i,j}$ are constants, based on the inner central point of the panel in a three-dimensional orthogonal coordinates system defined by the x, y and z axes, Px and Py are defined by the following formula:

$$Px = \frac{A_{20}}{A_{20} + A_{40}},\ Py = \frac{A_{02}}{A_{02} + A_{04}}.$$

8. The panel of claim 7 wherein the outer surface of the panel is substantially flat.

9. The panel of claim 7, further comprising an effective portion with a diagonal length of at least 580 mm.

10. The panel of claim 7, further comprising a center with a thickness of at least 12 mm.

11. The panel of claim 7, wherein the panel further satisfies the following condition:

$$0.25 \leqq Px \leqq 0.35,\ 0.35 \leqq Py \leqq 0.45.$$

* * * * *